US009330568B2

(12) United States Patent
Wang et al.

(10) Patent No.: US 9,330,568 B2
(45) Date of Patent: May 3, 2016

(54) METHODS, SYSTEMS AND PROCESSOR-READABLE MEDIA FOR PARKING OCCUPANCY DETECTION UTILIZING LASER SCANNING

(71) Applicant: Xerox Corporation, Norwalk, CT (US)

(72) Inventors: Yao Rong Wang, Webster, NY (US); David Cummins, Washington, DC (US); Matthew Darst, Chicago, IL (US); Graham Pennington, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 215 days.

(21) Appl. No.: 14/066,954

(22) Filed: Oct. 30, 2013

(65) Prior Publication Data

US 2015/0116134 A1 Apr. 30, 2015

(51) Int. Cl.
*G08G 1/14* (2006.01)

(52) U.S. Cl.
CPC . *G08G 1/14* (2013.01); *G08G 1/147* (2013.01)

(58) Field of Classification Search
CPC ..... G08G 1/14; G08G 1/147; G08G 1/0112; G08G 1/0133; G08G 1/144; G08G 1/0141; G08G 1/04; G08G 1/143; G08G 1/127; G08G 1/20; B60R 1/00; B60R 2300/806; G06K 9/00785; H04N 7/18
USPC ..... 340/932.2, 937, 933; 348/148, 143, 348/149, 159
See application file for complete search history.

(56) References Cited

U.S. PATENT DOCUMENTS

| | | | | |
|---|---|---|---|---|
| 5,638,302 | A | 6/1997 | Gerber | |
| 7,116,246 | B2 * | 10/2006 | Winter et al. | 340/932.2 |
| 8,502,698 | B2 | 8/2013 | Chen et al. | |
| 8,872,674 | B1 * | 10/2014 | Subramanya | 340/933 |
| 9,097,800 | B1 * | 8/2015 | Zhu | |
| 2010/0085437 | A1 * | 4/2010 | Troy et al. | 348/211.7 |
| 2013/0039532 | A1 | 2/2013 | Carbonell et al. | |
| 2013/0057686 | A1 * | 3/2013 | Genc et al. | 348/148 |

(Continued)

FOREIGN PATENT DOCUMENTS

| | | |
|---|---|---|
| EP | 1 905 656 A1 | 4/2008 |
| EP | 2 079 062 A2 | 7/2009 |
| EP | 2 082 386 B1 | 9/2010 |

OTHER PUBLICATIONS

U.S. Appl. No. 13/935,605, filed Jul. 5, 2013, Wang et al.

(Continued)

*Primary Examiner* — Anh V La
(74) *Attorney, Agent, or Firm* — Kermit D. Lopez; Luis M. Ortiz; Ortiz & Lopez, PLLC

(57) ABSTRACT

Parking occupancy detection methods, systems and processor-readable media. A laser device unit includes a laser range finder, and a programmable pan-tilt unit is deployable on site to monitor one or more parking spaces. A laser emitting and receiving unit associated with the laser range finder determines the distance of an object by estimating a time difference between an emitted laser and a received laser. The laser range finder is controllable by the programmable pan-tilt unit and scans the parking spaces. A signal-processing unit can convert the measured distance profile to a parking occupancy data to provide continuous parking space estimation data for use in parking occupancy detection.

20 Claims, 7 Drawing Sheets

(56) References Cited

U.S. PATENT DOCUMENTS

| | | | |
|---|---|---|---|
| 2013/0147954 | A1 | 6/2013 | Song et al. |
| 2013/0249711 | A1 | 9/2013 | Vellore Sripathi Rao |
| 2013/0258107 | A1 | 10/2013 | Delibaltov et al. |
| 2013/0262059 | A1 | 10/2013 | Grbovic et al. |
| 2013/0265419 | A1 | 10/2013 | Bulan et al. |
| 2013/0266187 | A1 | 10/2013 | Bulan et al. |
| 2013/0266188 | A1 | 10/2013 | Bulan et al. |

OTHER PUBLICATIONS

AXIS YP3040 Pan-Tilt Motor—camera outdoor pan/tilt with presets (24VAC), http://www.cdw.com/shop/products/AXIS-YP3040-Pan-Tilt-Motor-camera-outdoor-pan-tilt-with-presets-24-VAC/1997841.aspx?cm_mmc=ShoppingFeeds-__-GoogleBase-__-NetComm%20Products/Network%20Security-__-1997841__AXIS%20YP3040%20Pan-Tilt%20Motor%20-%20camera%20outdoor%20pan__tilt%20with%20presets%20(24%20VAC)__AXI-5502-461, printed Oct. 28, 2013, 4 pages.

Callaway Nikon iQ Laser Rangefinders, http://www.tgw.com/customer/category/product.jsp/SUBCATEGORY__ID/15260&CID=MC&SITE__ID=W8831?LNK=MC-SH&mcreferralID=02b47c85-f2ca-11e2-9dea-001b2166becc, printed Oct. 28, 2013, 3 pages.

Fybr—Better Communities Through Better Parking, http://streetsmarttechnology.com, printed Oct. 28, 2013, 4 pages.

Raspberry-PI—Raspberry-MODB-512M—Model B, http://www.newark.com/jsp/search/productdetail.jsp?SKU=43W5302&CMP=KNC-GPLA&mcky=|pcrid|20706799101|plid|, printed Oct. 28, 2013, 2 pages.

* cited by examiner

METHODS, SYSTEMS AND PROCESSOR-READABLE MEDIA FOR PARKING OCCUPANCY DETECTION UTILIZING LASER SCANNING

FIELD OF THE INVENTION

Embodiments are generally related to the field of parking management. Embodiments are also related to parking occupancy detection techniques and applications thereof. Embodiments are additionally related to laser scanning devices, methods, and systems.

BACKGROUND

A balance between supply and demand must be determined to meet the parking requirements of motorists. The ability to efficiently allocate and manage on-street parking remains elusive, even when parking requirements are significant, recurring, and known ahead of time. For instance, urban parking spaces characteristically undergo periods of widely skewed demand and utilization, with low demand and light use in some periods, often during the night, and heavy demand and use at other times. Real-time parking occupancy detection systems are an emerging technology in parking management.

Some prior art parking occupancy detection approaches utilize a puck-style/ultrasonic sensor configuration that outputs a binary signal when detecting a vehicle in, for example, a parking stall or a particular parking space. FIGS. 1-2, for example, illustrate respective parking occupancy detection systems 100 and 150 for parking occupancy detection in an on-street parking and parking lot. In the example depicted in FIG. 1, system 100 includes one or more puck-style in-/above-ground sensors 102, 104, 106. Also depicted in FIG. 1 are example parking spaces 108, 110, 112, 114. A vehicle 116 is shown parked in parking space 110 in FIG. 1. It can be assumed that the sensor 104 located closest to the parking space 110 can be employed in the detection of vehicle 116 located in parking space 110.

System 150 shown in FIG. 2, on the other hand, can include an image capturing unit 190 deployed on-site to monitor the parking spaces 160, 162, and 164. The captured video is processed real-time to report available parking space to drivers. In the example shown in FIGS. 1-2, the various sensors 102, 104, 106 and the image capturing unit 190 can provide real-time data in order to aid drivers searching for the parking spaces and to reduce traffic congestion in cities due to drivers circling about parking lots in a wasteful and time consuming effort to find parking spaces. Such prior art parking space management and reservation systems are based on the use of sensor input data for determining parking space availability and is costly.

Based on the foregoing, it is believed that a need exists for an improved parking occupancy detection system and method utilizing laser scanning, as will be described in greater detail herein.

SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for improved parking management methods and systems.

It is another aspect of the disclosed embodiments to provide for improved parking occupancy detection techniques.

It is yet another aspect of the disclosed embodiments to provide for an improved method and system for detecting parking occupancy utilizing laser scanning The aforementioned aspects and other objectives and advantages can now be achieved as described herein. Parking occupancy detection methods, systems and processor-readable media are disclosed. A laser device unit can be configured and provided, which includes a laser range finder. A programmable pan-tilt unit can be deployed on site to monitor one or more parking spaces. A laser emitting and receiving unit associated with the laser range finder can determine the distance of an object by estimating a time difference between an emitted laser and a received laser. The laser range finder that is controlled by the programmable pan-tilt unit scans the parking spaces. A signal processing unit converts the measured distance profile to a parking occupancy data thereby proving continuous parking space estimation.

Optionally, a wireless transmission unit can transmit the parking occupancy data to a central processing unit for further processing and integration. The distance profile represents a sharp difference between the parked and un-parked spaces as the laser range finder scans through the parking spaces. Vehicles can be counted and the vehicle size and footage of available parking space can be estimated. The laser range finder and the pan-tilt unit provide sufficient measurement distance and resolution for parking application. The laser based parking occupancy detection system requires much less computational power compared with image-capturing based systems as it only requires signal processing rather than image processing. In addition, since a laser range finder can scan through a large area, the laser based parking occupancy detection system can offer significant cost savings compared with other parking occupancy detection systems.

BRIEF DESCRIPTION OF THE FIGURES

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

Figure 1:
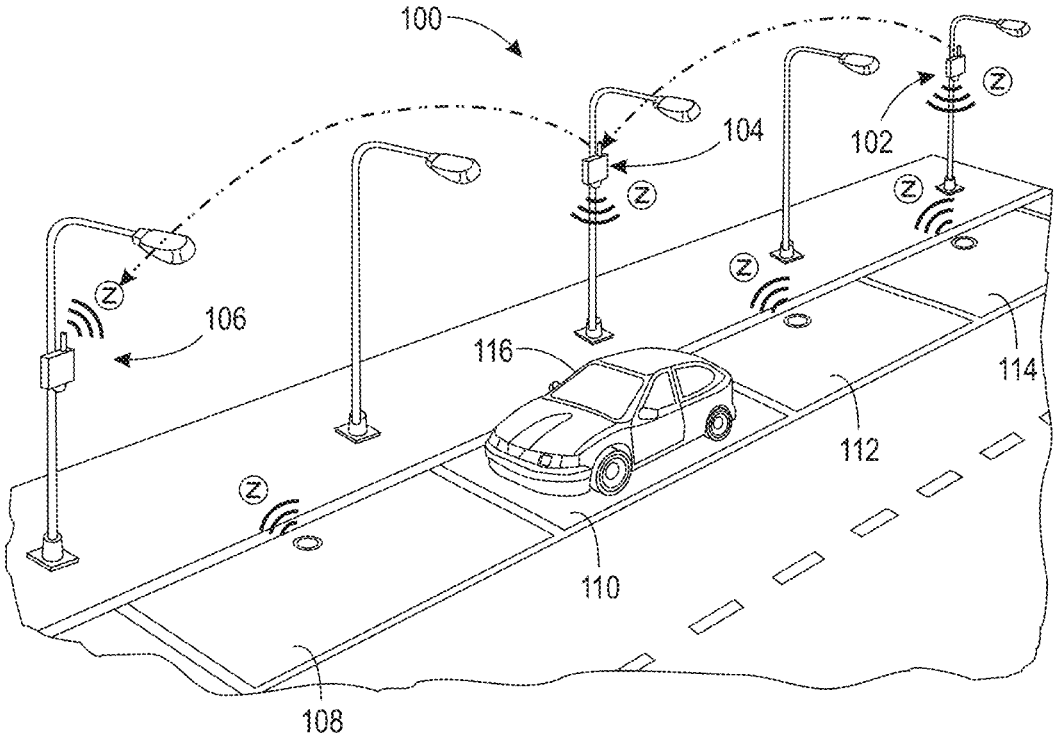
FIGS. 1-2 illustrate a parking occupancy detection system based on a puck-style sensor and an image capturing unit.
Figure 2:
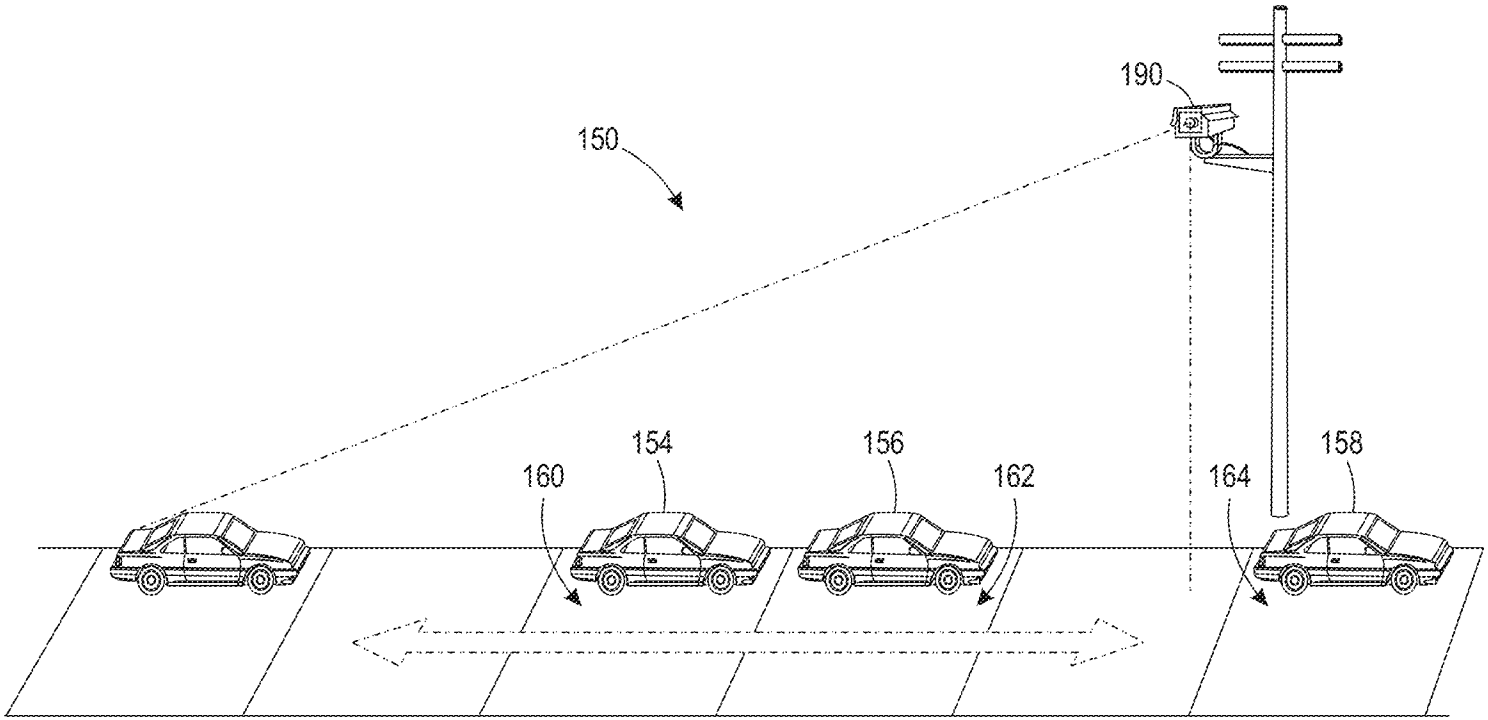

The particular values and configurations discussed in these non-limiting examples can be varied and are cited merely to illustrate at least one embodiment and are not intended to limit the scope thereof.

The embodiments will now be described more fully hereinafter with reference to the accompanying drawings, in which illustrative embodiments of the invention are shown. The embodiments disclosed herein can be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As will be appreciated by one skilled in the art, the present invention can be embodied as a method, data processing system, or computer program product. Accordingly, the present invention may take the form of an entire hardware embodiment, an entire software embodiment or an embodiment combining software and hardware aspects all generally referred to herein as a "circuit" or "module." Furthermore, the present invention may take the form of a computer program product on a computer-usable storage medium having computer-usable program code embodied in the medium. Any suitable computer readable medium may be utilized including hard disks, USB flash drives, DVDs, CD-ROMs, optical storage devices, magnetic storage devices, etc.

Computer program code for carrying out operations of the present invention may be written in an object oriented programming language (e.g., JAVA, C++, etc.). The computer program code, however, for carrying out operations of the present invention may also be written in conventional procedural programming languages such as the "C" programming language or in a visually oriented programming environment such as, for example, Visual Basic.

The program code may execute entirely on the user's computer, partly on the user's computer, as a stand-alone software package, partly on the user's computer and partly on a remote computer or entirely on the remote computer. In the latter scenario, the remote computer may be connected to a user's computer through a local area network (LAN) or a wide area network (WAN), wireless data network e.g., WiFi, WiMax, 802.11x, and cellular network or the connection can be made to an external computer via most third party supported networks (e.g., through the Internet via an internet service provider).

The embodiments are described at least in part herein with reference to flowchart illustrations and/or block diagrams of methods, systems, and computer program products and data structures according to embodiments of the invention. It will be understood that each block of the illustrations, and combinations of blocks, can be implemented by computer program instructions. These computer program instructions may be provided to a processor of a general-purpose computer, special purpose computer, or other programmable data processing apparatus to produce a machine such that the instructions, which execute via the processor of the computer or other programmable data processing apparatus, create means for implementing the functions/acts specified in the block or blocks.

These computer program instructions may also be stored in a computer-readable memory that can direct a computer or other programmable data processing apparatus to function in a particular manner such that the instructions stored in the computer-readable memory produce an article of manufacture including instruction means which implement the function/act specified in the block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the block or blocks.

Figure 3:
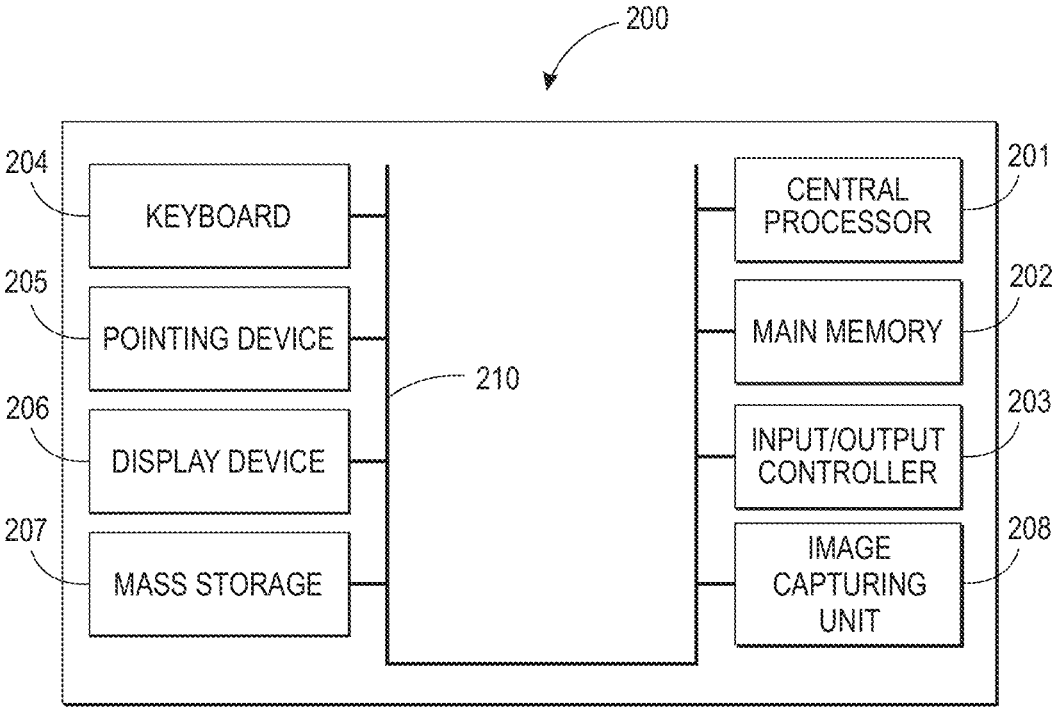
FIG. 3 illustrates a schematic view of a computer system, in accordance with the disclosed embodiments.
Figure 4:
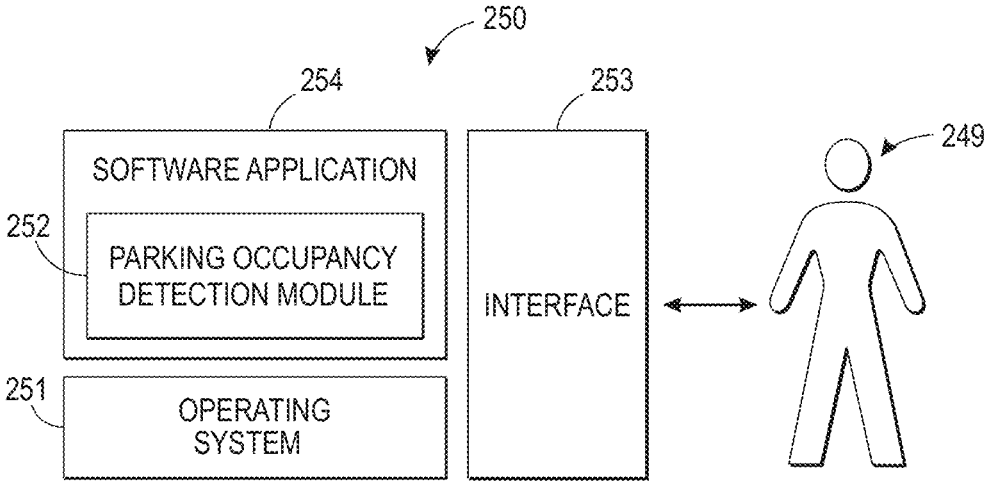
FIG. 4 illustrates a schematic view of a software system including a laser-based parking occupancy detection module, an operating system, and a user interface, in accordance with the disclosed embodiments.

FIGS. 3-4 are provided herein as exemplary diagrams of data-processing environments in which embodiments may be implemented. It should be appreciated that FIGS. 3-4 are only exemplary and are not intended to assert or imply any limitation with regard to the environments in which aspects or embodiments are implemented. Many modifications to the depicted environments may be made without departing from the spirit and scope of the disclosed embodiments.

As illustrated in FIG. 3, an example embodiment may include a data-processing system 200 that includes, for example, a central processor 201, a main memory 202, an input/output controller 203, a keyboard 204, an input device 205 (e.g., a pointing device such as a mouse, track ball, pen device, etc.), a display device 206, a mass storage 207 (e.g., a hard disk), and an image capturing unit 208. As illustrated, the various components of data-processing system 200 can communicate electronically through a system bus 210 or similar architecture. The system bus 210 may be, for example, a subsystem that transfers data between, for example, computer components within data-processing system 200 or to and from other data-processing devices, components, computers, etc.

FIG. 4 illustrates a computer software system 250 for directing the operation of the data-processing system 200 depicted in FIG. 3. Software application 254, stored in main memory 202 and on mass storage 207, generally includes a kernel or operating system 251 and a shell or interface 253. One or more application programs, such as software application 254, may be "loaded" (i.e., transferred from mass storage 207 into the main memory 202) for execution by the data-processing system 200. The data-processing system 200 can receive user commands and/or data through user interface 253. Such inputs may then be acted upon by the data-processing system 200 in accordance with instructions from operating system module 251 and/or software application 254.

Figure 6:
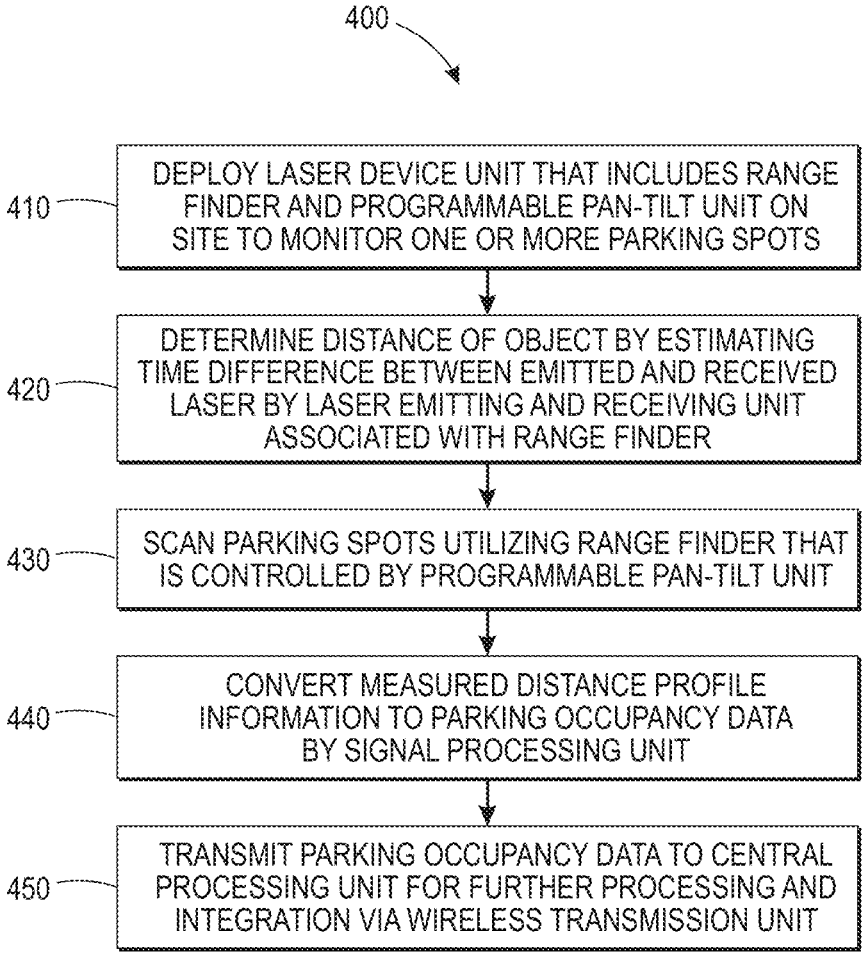
FIG. 6 illustrates a high level flow chart of operations illustrating logical operational steps of a method for detecting parking occupancy utilizing laser scanning, in accordance with the disclosed embodiments.

Examples of instructions that may be provided by software application 254 or system module 251 are the instructions or operations such as those shown in blocks 410, 420, 430, 440 and 450 of FIG. 6.

The following discussion is intended to provide a brief, general description of suitable computing environments in which one or more embodiments may be implemented. Although not required, the disclosed embodiments are described with respect to some embodiments in the general context of computer-executable instructions, such as program modules, being executed by a single computer. In most instances, a "module" constitutes a software application, but can also constitute hardware components.

Generally, program modules include, but are not limited to, routines, subroutines, software applications, programs, objects, components, data structures, etc., that perform particular tasks or implement particular abstract data types and instructions. Moreover, those skilled in the art will appreciate that the disclosed method and system may be practiced with other computer system configurations such as, for example, hand-held devices, multi-processor systems, data networks, microprocessor-based or programmable consumer electronics, networked personal computers, minicomputers, mainframe computers, servers, and the like.

Note that the term module as utilized herein may refer to a collection of routines and data structures that perform a particular task or implements a particular abstract data type. Modules may be composed of two parts: an interface, which lists the constants, data types, variable, and routines that can be accessed by other modules or routines, and an implementation, which is typically private (accessible only to that module) and which includes source code that actually implements the routines in the module. The term module may also simply refer to an application such as a computer program designed to assist in the performance of a specific task such as word processing, accounting, inventory management, etc. Of course, a module may also be a hardware component and/or combined with software, depending upon the application. An example of a module is the module 252 shown in FIG. 5, which may contain software and/or hardware components or aspects and can also maintain and process data such as the parking occupancy data 328 and distance profile information 326.

The interface 253, which is preferably a graphical user interface (GUI), can serve to display results, whereupon a user may supply additional inputs or terminate a particular session. In some embodiments, operating system 251 and interface 253 can be implemented in the context of a "windows" system. It can be appreciated, of course, that other types of systems are possible. For example, rather than a traditional "windows" system, other operation systems such as, for example, a real time operating system (RTOS) more commonly employed in wireless systems may also be employed with respect to operating system 251 and interface 253. The software application 254 can include, for example, a laser-based parking occupancy detection module 252 for detecting parking occupancy. The laser-based parking occupancy detection module 252 can include instructions such as those of method 400 discussed herein with respect to FIG. 6.

FIGS. 3-4 are thus intended as examples and not as architectural limitations of disclosed embodiments. Additionally, such embodiments are not limited to any particular application or computing or data-processing and/or hardware environment. Instead, those skilled in the art will appreciate that the disclosed approach may be advantageously applied to a variety of systems and application software and/or hardware. Moreover, the disclosed embodiments can be embodied on a variety of different computing platforms including Macintosh, Unix, Linux, and the like and/or varying hardware.

Figure 5:
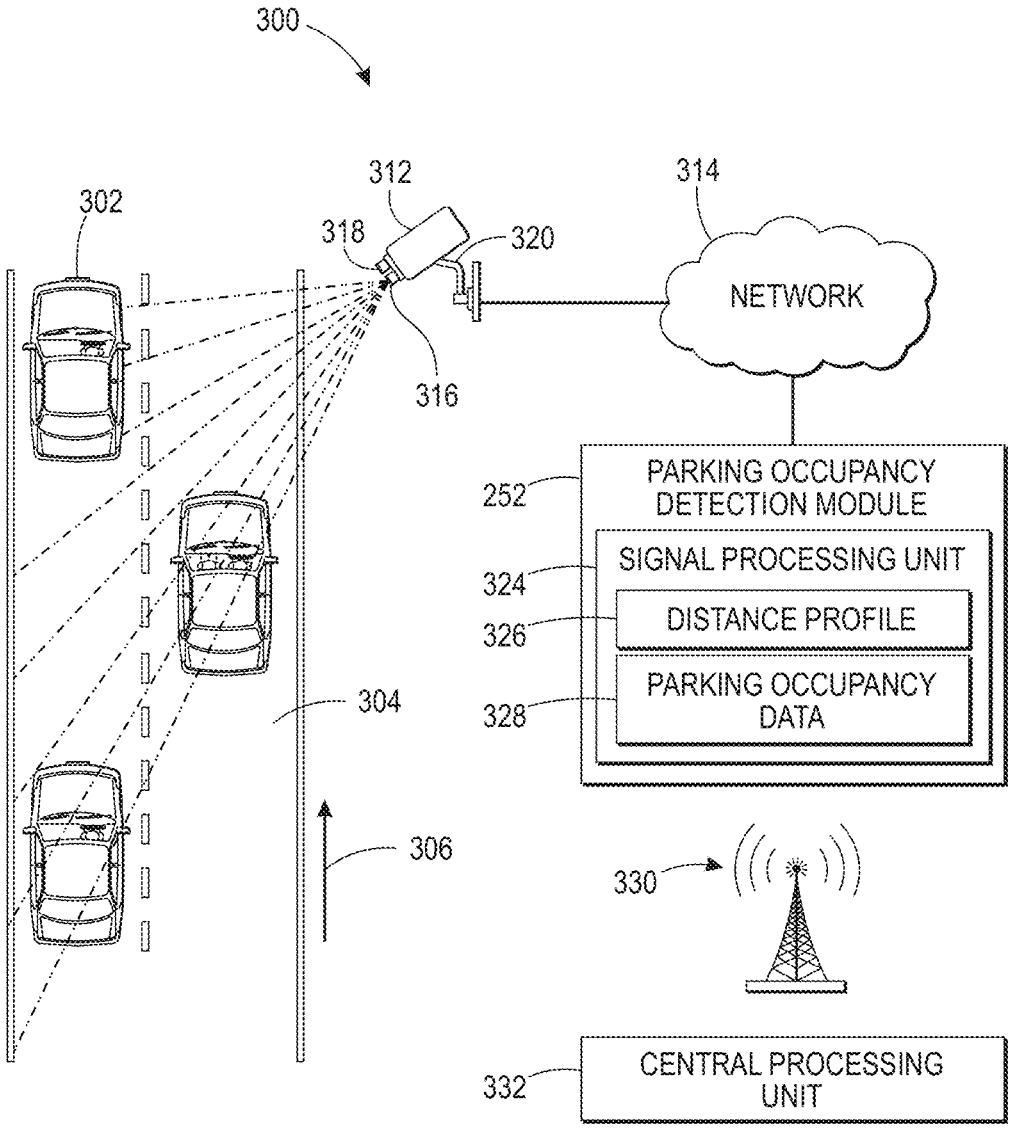
FIG. 5 illustrates a block diagram of a laser-based parking occupancy detection system, in accordance with the disclosed embodiments.

FIG. 5 illustrates a block diagram of a laser-based parking occupancy detection system 300, in accordance with the disclosed embodiments. Note that in FIGS. 1-10, identical or similar blocks are generally indicated by identical reference numerals. The laser-based parking occupancy detection system 300 generally includes a laser device 312 and the laser-based parking occupancy detection module 252 to monitor one or more parking spaces 304. The laser device 312 further includes a laser range finder 318 and a programmable pan-tilt unit 320. The laser device 312 emits light through a process of optical amplification based on the stimulated emission of electromagnetic radiation. The term "laser" originated as an acronym for Light Amplification by Stimulated Emission of Radiation. Lasers differ from other sources of light because they emit light coherently.

The laser range finder 318 further includes a laser emitting and receiving unit 316 that employs a laser beam to determine the distance to an object. The most common form of laser range finder 318 operates on the time of flight principle by sending a laser pulse in a narrow beam towards the object and measuring the time taken by the pulse to be reflected off the target and returned to the sender. The laser range finder 318 determines distance of the object by estimating time difference between the emitted and received laser by the laser emitting and receiving unit 316.

The programmable pan-tilt unit 320 permits the laser range finder 318 to scan through the parking spaces 304. The laser scan direction is indicated by arrow 306. The pan-tilt unit 320 can usually pan or tilt in the speed of 60 degrees per second, which is fast enough for parking applications. The laser-based parking occupancy detection module 252 further includes a signal processing unit 324 to convert the measured distance profile 326 to a parking occupancy data 328. The measured distance profile 326 can be transmitted to the signal processing unit 324 via a network 314.

Note that the network 314 may employ any network topology, transmission medium, or network protocol. The network 314 may include connections such as wire, wireless communication links, or fiber optic cables. Network 314 can also be an Internet representing a worldwide collection of networks and gateways that use the Transmission Control Protocol/Internet Protocol (TCP/IP) suite of protocols to communicate with one another. At the heart of the Internet is a backbone of high-speed data communication lines between major nodes or host computers, consisting of thousands of commercial, government, educational, and other computer systems that route data and messages.

The distance profile 326 represents a sharp difference between the parked and un-parked spaces as the laser range finder 318 scans through the parking spaces 304. The vehicles 302 can be counted and the size of the vehicle 302 can be estimated. Optionally, a wireless transmission unit 330 can be employed for transmitting the occupancy data 328 to a central processing unit 332 for further processing and integration.

FIG. 6 illustrates a high level flow chart of operations illustrating logical operational steps of a method 400 for detecting parking occupancy utilizing laser scanning, in accordance with the disclosed embodiments. It can be appreciated that the logical operational steps shown in FIG. 6 can be implemented or provided via, for example, a module such as module 252 shown in FIG. 1 and can be processed via a processor such as, for example, the processor 201 shown in FIG. 3.

Initially, the laser device 312, which includes the laser range finder 318 and the programmable pan-tilt unit 320, can be deployed on site to monitor the parking spaces 304, as indicated at block 410. The distance of the object can be determined by estimating time difference between the emitted and received laser by the laser emitting and receiving unit 316 associated with laser range finder 318, as shown at block 420. The programmable pan-tilt unit 320 permits the laser range finder 318 to scan through the parking spaces 304, as illustrated at block 430. The measured distance profile 326 can be converted to the parking occupancy data 328 by the signal processing unit 324, as depicted at block 440. Optionally, the parking occupancy data 328 can be transmitted to the central processing unit 332 for further processing and integration via the wireless transmission unit 330, as illustrated at block 450.

Figure 7:
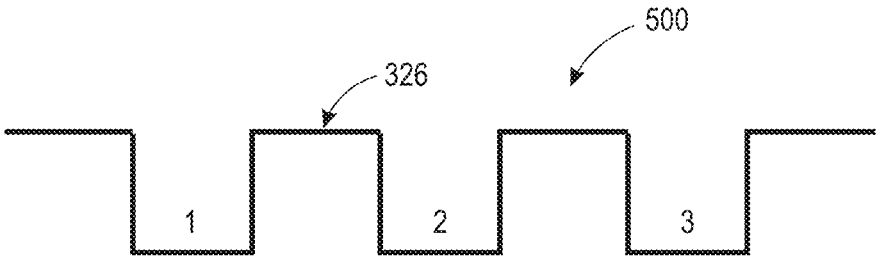
FIG. 7 illustrates a graphical representation of a distance profile from a laser range finder, in accordance with the disclosed embodiments.
Figure 8:
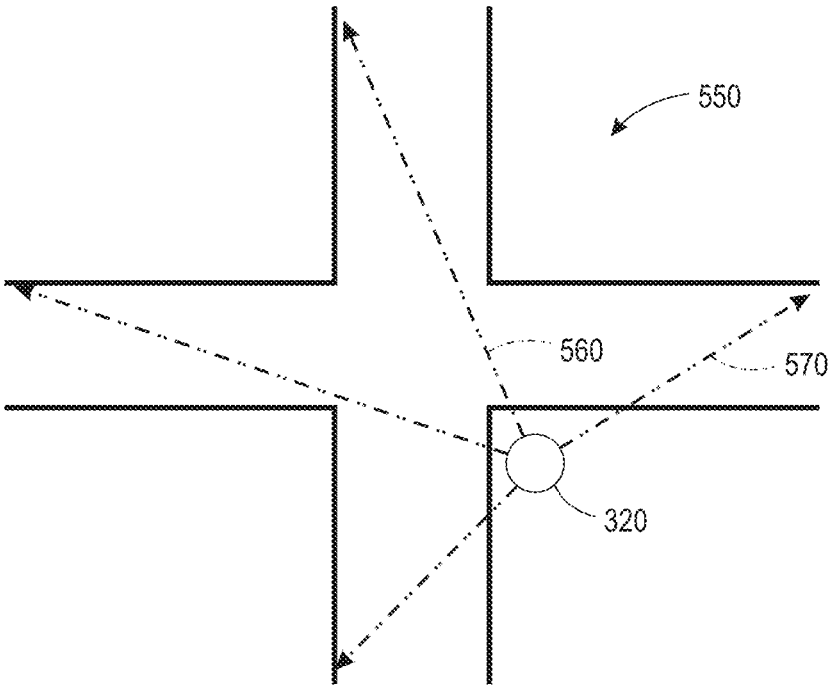
FIG. 8 illustrates a schematic representation of parking space coverage by the laser-based parking occupancy detection system, in accordance with the disclosed embodiments.

FIG. 7 illustrates a graphical representation 500 of the distance profile 326 from the laser range finder 318, in accordance with the disclosed embodiments. FIG. 8 illustrates a schematic representation of parking space coverage 550 by the laser-based parking occupancy detection system 300, in accordance with the disclosed embodiments. The pan range and the tilt range are indicated by arrows 570 and 560 respectively. The laser range finder 318 and the pan-tilt unit 320 provide enough measurement distance and resolution for parking application.

Figure 9:
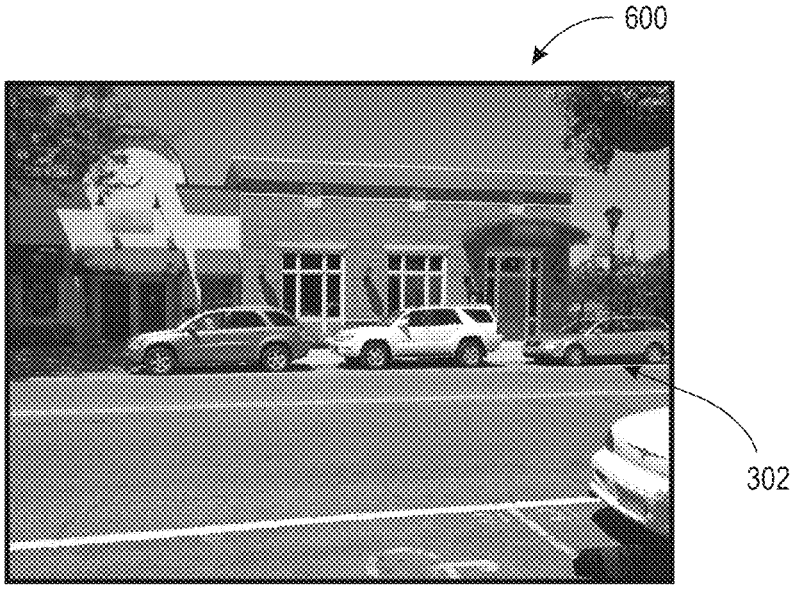
FIGS. 9-10 illustrate a street scene and distance profile with respect to the street scene, in accordance with the disclosed embodiments.
Figure 10:
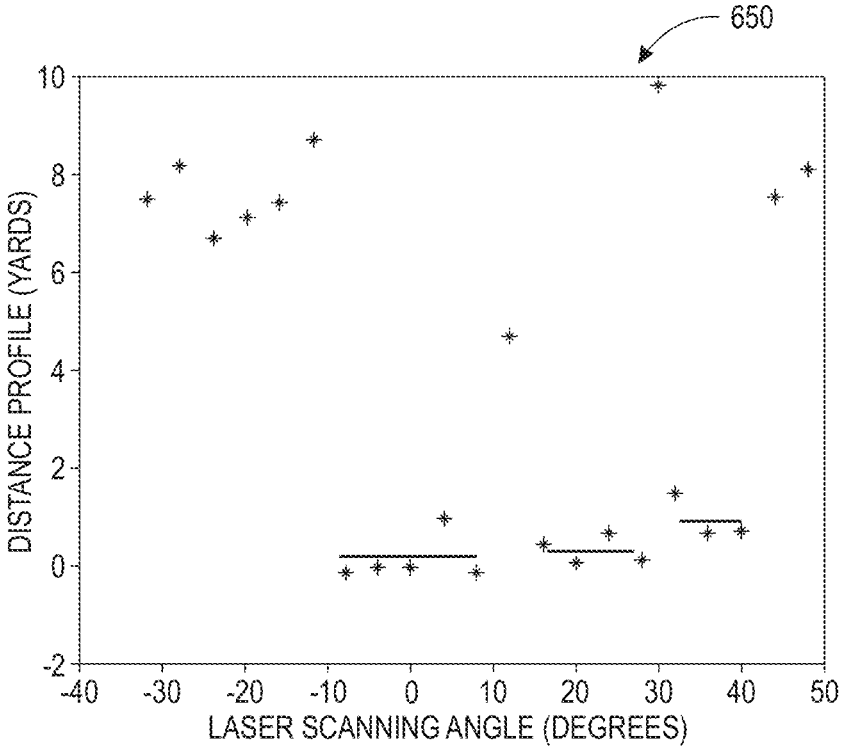

FIGS. 9-10 illustrate a street scene 600 and distance profile 650 for the street scene 600, in accordance with the disclosed embodiments. For example, the laser range finder 318 can be placed across the street, which is about 15 yard wide. The laser range finder 318 scans every 4 degrees and the distance profile (for horizontal scanning) can be defined as shown below in equation (1):

$$D=y-A/\cos(\theta) \quad (1)$$

Where y represents the measured distance from the laser range finder 318, A represents the horizontal distance from the laser finder 318 to a "vehicle" parked directly across the street, and θ represents the scan angle. The vehicle parked on the street should have D close to zero.

FIG. 10 illustrates the distance profile 650 against scanning angles and the three vehicles on the image can be counted from the distance profile 326. The laser based parking occupancy detection system 300 permits continuous parking space estimation and determines vehicle size and the footage of available parking space. The laser-based parking occupancy detection system 300 requires much less computational power for signal processing and offer significant cost savings.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art, which are also intended to be encompassed by the following claims.

The invention claimed is:

1. A parking occupancy detection method, comprising:

determining a distance profile via a laser range finder with respect to an object by estimating a time difference between an emitted laser and a received laser with respect to monitoring at least one parking space;

scanning said at least one parking space and generating a measured distance profile via a programmable pan-tilt unit that communicates electronically with said laser range finder and controls a movement of said laser range finder to scan said at least one parking space and generate said measured distance profile; and converting said measured distance profile to parking occupancy data by a signal processing unit based on data provided by said laser range finder to generate parking space estimates for use in compiling said parking occupancy data.

2. The method of claim 1 wherein said laser range finder and said programmable pan-tilt unit are associated with a laser device deployed on-site for monitoring said at least one parking space.

3. The method of claim 2 wherein said laser range finder further comprises a laser emitting and receiving unit that emits said emitted laser and receives said received laser.

4. The method of claim 2 wherein said laser range finder provides a difference between a parked space and an unparked space with respect to said measured distance profile as said laser range finder scans said at least one parking space and wherein said measured distance profile for said scanning comprising horizontal scanning is defined by an equation $D=y-A/\cos(\theta)$ where D represents said measured distance profile, y represents a measured distance from said laser range finder, A represents a horizontal distance from said laser range finder to a parked vehicle, and θ represents a scan angle with respect to said scanning said at least one parking space.

5. The method of claim 4 wherein said laser range finder counts said vehicle located in said at least one parking space and estimates a size of said at least one parking space.

6. The method of claim 4 further comprising providing a wireless transmission unit for transmitting said parking occupancy data to a central processing unit, wherein said wireless transmission unit communicates electronically and/or wirelessly with said processing unit.

7. The system of claim 5 further comprising providing a wireless transmission unit for transmitting said parking occupancy data to a central processing unit, wherein said wireless transmission unit communicates electronically and/or wirelessly with said processing unit.

8. A parking occupancy detection system, comprising:

a laser range finder that determines a distance profile with respect to an object by estimating a time difference between an emitted laser and a received laser with respect to monitoring at least one parking space;

a programmable pan-tilt unit that communicates electronically with said laser range finder and controls a movement of said laser range finder to scan said at least one parking space and generate a measured distance profile; and a signal processing unit that converts said measured distance profile based on data provided by said laser range finder to generate parking occupancy data to thereby provide parking space estimates for use in compiling parking occupancy data.

9. The system of claim 8 wherein said laser range finder and said programmable pan-tilt unit are associated with a laser device deployed on-site for monitoring said at least one parking space.

10. The system of claim 9 wherein said laser range finder further comprises a laser emitting and receiving unit that emits said emitted laser and receives said received laser.

11. The system of claim 9 wherein said laser range finder provides a difference between a parked space and an unparked space with respect to said measured distance profile as said laser range finder scans said at least one parking space.

12. The system of claim 9 wherein said laser range finder counts a vehicle located in said at least one parking space and estimates a size of said at least one parking space and wherein said measured distance profile for said scanning comprising horizontal scanning is defined by an equation $D=y-A/\cos(\theta)$ where D represents said measured distance profile, y represents a measured distance from said laser range finder, A represents a horizontal distance from said laser range finder to a parked vehicle and θ represents a scan angle with respect to said scanning said at least one parking space.

13. The system of claim 10 further comprising a wireless transmission unit for transmitting said parking occupancy data to a central processing unit, wherein said wireless transmission unit communicates electronically and/or wirelessly with said processing unit.

14. The system of claim 12 further comprising a wireless transmission unit for transmitting said parking occupancy data to a central processing unit, wherein said wireless transmission unit communicates electronically and/or wirelessly with said processing unit.

15. A non-transitory processor-readable medium storing computer code representing instructions to cause a process for parking occupancy detection, said computer code further comprising code to:

determine a distance profile via a laser range finder with respect to an object by estimating a time difference between an emitted laser and a received laser with respect to monitoring at least one parking space;

scan said at least one parking space and generating a measured distance profile via a programmable pan-tilt unit that communicates electronically with said laser range finder and controls a movement of said laser range finder to scan said at least one parking space and generate said measured distance profile; and convert said measured distance profile to parking occupancy data by a signal processing unit based on data provided by said laser range finder to generate parking space estimates for use in compiling said parking occupancy data.

16. The non-transitory processor-readable medium of claim 15 wherein said laser range finder and said programmable pan-tilt unit are associated with a laser device deployed on-site for monitoring said at least one parking space.

17. The non-transitory processor-readable medium of claim 16 wherein said laser range finder further comprises a laser emitting and receiving unit that emits said emitted laser and receives said received laser.

18. The non-transitory processor-readable medium of claim 16 wherein said laser range finder provides a difference between a parked space and an un-parked space with respect to said measured distance profile as said laser range finder scans said at least one parking space and wherein said measured distance profile for said scanning comprising horizontal scanning is defined by an equation $D=y-A/\cos(\theta)$ where D represents said measured distance profile, y represents a measured distance from said laser range finder, A represents a horizontal distance from said laser range finder to a parked vehicle, and θ represents a scan angle with respect to said scanning said at least one parking space.

19. The non-transitory processor-readable medium of claim 18 wherein said laser range finder counts a vehicle located in said at least one parking space and estimates a size of said at least one parking space.

20. The non-transitory processor-readable medium of claim 18 wherein said code further comprises code to instruct a wireless transmission unit to transmit said parking occupancy data to a central processing unit, wherein said wireless transmission unit communicates electronically and/or wirelessly with said processing unit.

* * * * *